United States Patent [19]

Rogers

[11] 4,267,985

[45] May 19, 1981

[54] STRIP SEPARATOR AND PAYOUT APPARATUS

[76] Inventor: John W. Rogers, 22175 Douglas Rd., Shaker Heights, Ohio 44122

[21] Appl. No.: 129,966

[22] Filed: Mar. 13, 1980

[51] Int. Cl.[3] ..... B65H 35/02; B26F 3/00

[52] U.S. Cl. ..... 242/56.4; 225/93; 225/103

[58] Field of Search ..... 242/56.4, 58.6, 56.2, 242/81; 225/93, 102, 103, 4

[56] References Cited

U.S. PATENT DOCUMENTS 2,742,965 4/1956 Drummond ..... 225/93 X 2,998,134 8/1961 Gray ..... 225/4 X 3,904,097 9/1975 Grambo ..... 225/103

4,191,318 3/1980 Rogers ..... 242/56.4

*Primary Examiner*—Edward J. McCarthy

*Attorney, Agent, or Firm*—John F. Carney

[57] ABSTRACT

Apparatus is described for detaching a coiled strip from a wound sheet material construct containing a plurality of coiled strips interconnected by intermittently spaced tabs of partially sheared material that bridge the parting lines between adjacent strips. The apparatus is effective to separate the selected coiled strip from the construct and to thereafter pay out the strip to a point of use.

8 Claims, 8 Drawing Figures

STRIP SEPARATOR AND PAYOUT APPARATUS

BACKGROUND OF THE INVENTION

An improved practice for the production of coiled sheet metal strip material is described in U.S. Pat. Nos. 4,155,238, 4,170,691 and 4,173,313 granted May 22, 1979, Oct. 9, 1979 and Nov. 6, 1979, respectively, to John W. Rogers. According to this improved practice an elongated web of sheet metal is slit along parallel lines in a manner that produces parting lines containing intermittently spaced residuums of only partially sheared metal that bridge the parting line between adjacent strips and interconnect their facing edges. Thus, upon coiling of the slit product there results a wound construct containing a plurality of coiled strips integrally joined by frangible connections or tabs defined by the aforementioned partially sheared residuums of metal.

Detachment of individual strips from the construct can be effected by a breakaway device such as that described in U.S. patent application Ser. No. 898,001 to John W. Rogers filed Apr. 20, 1978 now U.S. Pat. No. 4,195,759, granted Apr. 1, 1980 in which all the interconnecting tabs in the parting line to be separated are fractured substantially simultaneously by the application of a shear force directly to the concerned strip coil. Separating coils in this manner requires great forces due to the requirement to break all the tabs substantially together. The magnitude of the forces that must be applied to the web material requires the use of heavy, expensive equipment. It furthermore places the material in danger of being damaged due to deformation of the coiled strip selected for removal or of the remaining construct.

The above problem is avoided, however, through the use of an alternate form of apparatus, such as that described in U.S. patent application Ser. No. 055,848 to John W. Rogers filed July 9, 1979 in which the tabs in each parting line to be severed are fractured sequentially by paying the concerned strip over a wedge-like body. Use of this apparatus significantly reduces the degree of force required to separate the strip; however, removal of the strip in coil form is precluded unless, of course, the payed out strip is subsequently rewound into a coil.

In U.S. patent application Ser. No. 129,964, filed Mar. 13, 1980 to William A. Box, there is described a method of and apparatus for fracturing the tabs that attach a coiled strip to a construct in a manner that retains the separated strip in a coil. According to the practice of this invention, however, before the separated coil can be payed out to a work station such as a stamping press or the like, it must be transferred to a strip uncoiler. To transfer the separated strip from the construct at the separation station to an uncoiler at the processing station, of course, requires an expenditure of time, effort and equipment that is costly to any production process.

This problem is addressed in U.S. patent application Ser. No. 972,552 to John W. Rogers, now U.S. Pat. No. 4,191,318 which discloses an integrated coil separating and pay-out apparatus that is capable of both detaching a strip coil from a construct and of enabling the strip material to be unwound for feeding to a processing station. The described apparatus, while being capable of performing its intended function, suffers from the drawback that excessive operating forces are required for severing a coil from the construct and in that an external motive force is required for uncoiling the separated strip material.

Accordingly, it is to an improved form of apparatus of the described type, therefore, that the present invention is directed.

SUMMARY OF THE INVENTION

Accordingly, the present invention provides apparatus for detaching and dispensing strip material from a wound construct having an axial opening therethrough and including a plurality of axially spaced coils of strip material interconnected by frangible connections, said apparatus comprising a frame including means for telescopically receiving said construct through the axial opening therein, a spinner rotatably attached to said frame, said spinner having an external diameter to be received in the axial opening of said construct, gripper means in said spinner for attaching the innermost free end of the strip to be separated, and mechanical drive means operatively connected to said spinner for rotating the same in a direction to create relative movement between the strip coil to be separated and the remainder of the construct to effect detachment of the frangible connections therebetween, said drive means being operative following separation of the strip coil to rotate said spinner for unwinding the strip material therein.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 1:
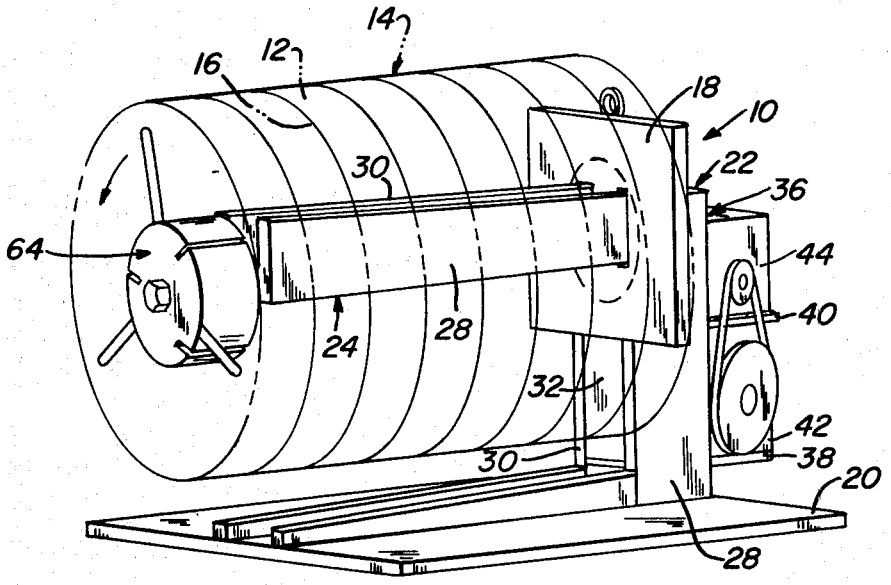
FIG. 1 is an isometric representation of apparatus according to the present invention during the strip coil separation phase of its operation.
Figure 2:
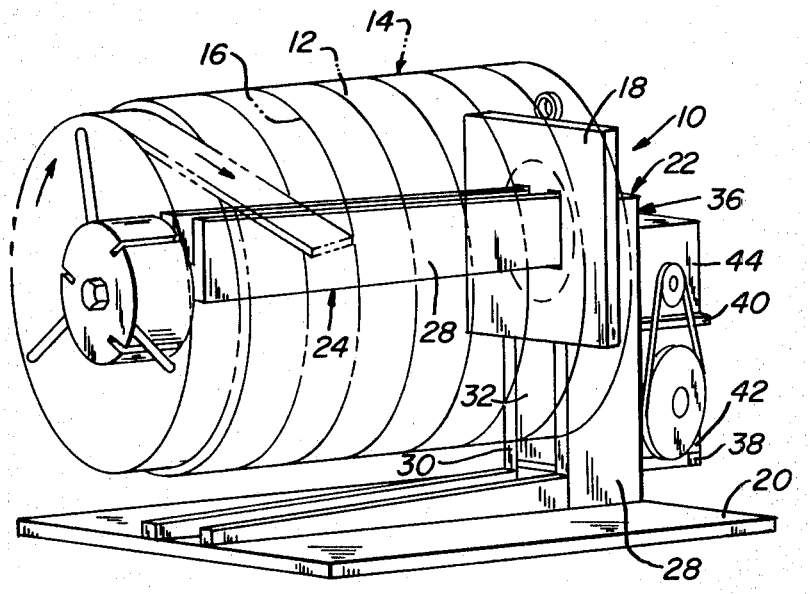
FIG. 2 is an isometric view similar to that of FIG. 1 illustrating the apparatus during the pay-out phase of its operation.
Figure 3:
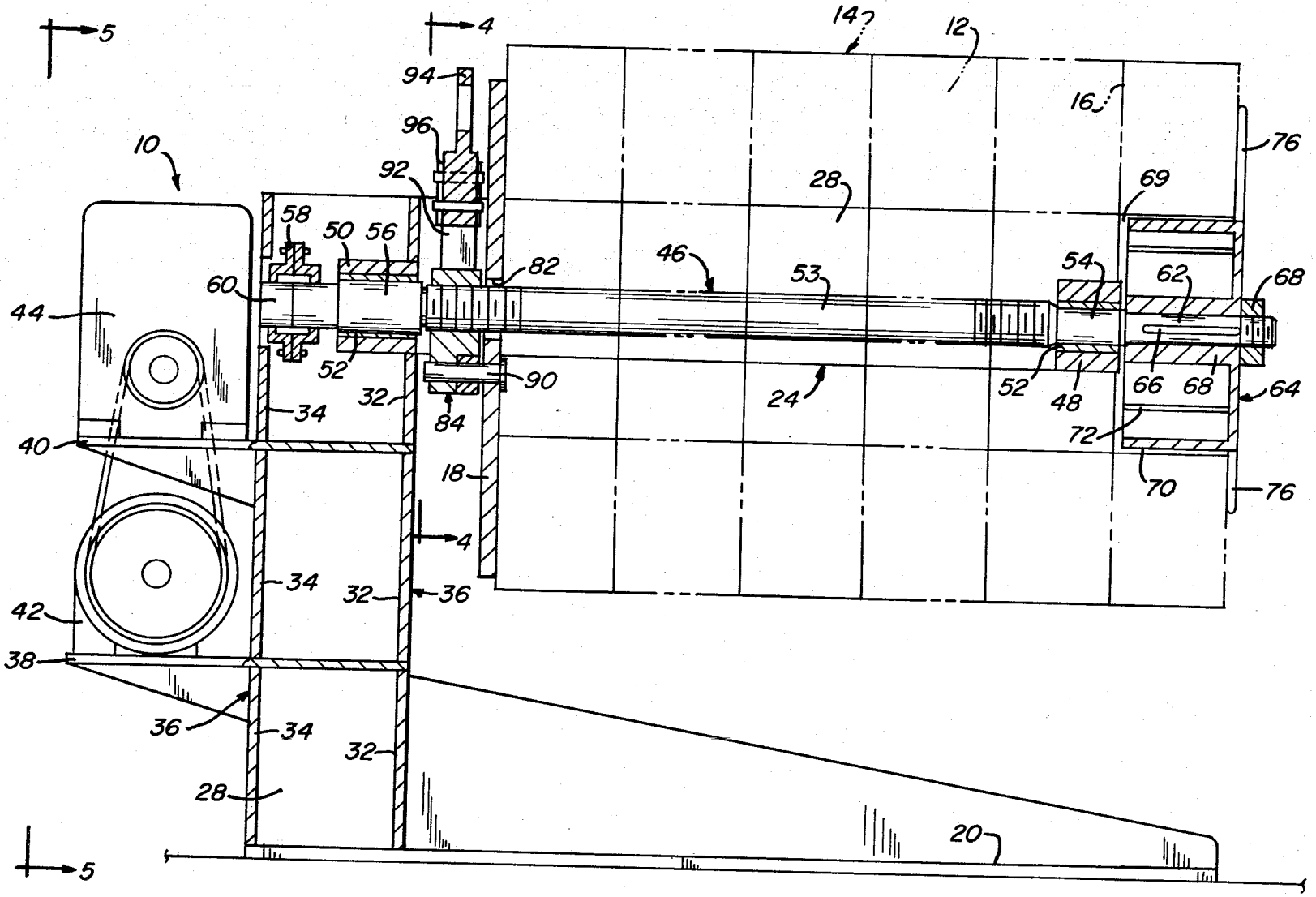
FIG. 3 is an elevational section of the apparatus illustrated in FIG. 1.

In the drawings there is shown apparatus 10 operative to detach individual coils 12 of strip material from a coil construct 14 of wound sheet metal web material and, thereafter, to mechanically dispense the strip by unwinding the separated coil. The construct 14, which is shown by phantom lines in the respective views, is of a type described in detail in U.S. Pat. No. 4,170,691 granted Oct. 9, 1979, to J. W. Rogers, the inventor herein. It is formed of wound sheet metal web material having a plurality of laterally spaced parting lines 16 defining frangibly interconnected coiled strips 12 therebetween. The parting lines 16 contain intermittently spaced tabs (not shown) formed during the slitting operation described best in U.S. patent application Ser. No. 045,910, filed June 6, 1979, by J. W. Rogers in which the web is slit in a manner to produce partially slit residual web material bridging the interstice between adjacent strips at spaced points along the respective parting lines.

Following slitting, the web material is wound upon a recoiler into the construct 14 in which the parting lines 16 are disposed in substantial coplanar or radially aligned relation.

The coil separating and dispensing apparatus 10 of the present invention is operative by means of a single drive mechanism to mechanically fracture the tabs connecting the respective coils 12 to the construct 14 and thereafter to mechanically unwind the separated coil to dispense the strip material therein. A pusher plate 18 on the apparatus is operated by the same drive mechanism for moving the construct to position coils to be separated into operative relationship with the tab fracturing device.

This apparatus 10 comprises a base 20 having a frame 22 upstanding therefrom and including a horizontally disposed construct support 24. The frame 22 is conveniently formed of a pair of oppositely spaced plate members 28 and 30 having vertical arms and horizontal arms disposed at right angles with respect to one another. The vertical arms of the plate members 28 30 are closed by plates 32, 34 to form a vertically disposed box column 36, the rear side of which is provided with vertically spaced platforms 38, 40 for mounting a reversible motor 42 and worm gear reducer 44 which cooperate to form part of the drive mechanism for the apparatus.

The horizontal arms of plate members 28 and 30 of the frame extend horizontally from the column 36 in spaced relation to one another and are adapted to receive a construct 14 through the axial opening therethrough. An elongated drive shaft 46 extends between these arms and is journalled for rotational movement by bearing mounts 48 and 50 containing bronze bushings 52. Bearing mount 48 comprises a block extending between and weldedly connected to the arms 30 at the free ends thereof. Bearing mount 50 is attached by welding to the uppermost plate 32 in the box column. As shown, the drive shaft 46 contains an externally threaded portion 53 formed with acme threads, or the like, intermediate a pair of smooth shouldered bearing portions 54 and 56. Rearwardly of the bearing portion 56 the shaft 46 is connected by way of a flexible coupling 58 to the output shaft 60 of the worm gear reducer 44. Forwardly of the bearing portion 56 the shaft 46 is provided with an extension 62 of slightly reduced diameter than the adjacent bearing portion to receive a spinner 64. Extension 62 contains an elongated keyway 66 for fixing the spinner thereto and a threaded end for reception of a lock nut 68.

Spinner 64 is a generally hollow cylindrical body having an integral hub 68 for reception on the drive shaft extension 62. The hub 68 abuts the shoulder formed between the bearing portion 56 of the shaft and extension 62 to form a clearance space 69 between the spinner body and the free end of the horizontal frame arms on plate members 28 and 30. The external surface 70 of the body is formed of a diameter to be received within the axial opening through a construct 14. For reasons that become more apparent hereinafter, the outer diameter of the spinner 64 is preferably such as will provide a clearance space between it and the facing, inner surface of the construct 14.

One or more gripper slots 72 are positioned about the body for reception in any one of such slots of the radially innermost free end or tang 74 (FIGS. 5, 6 and 7) of the strip coil to be separated. In practice, the tang 74 of sheet metal strip material is conveniently adapted for reception in a gripper slot 72 in that an inturned tang typically results during recoiling of the material following a slitting operation by virtue of the deformation of the metal resulting from its attachment by the gripper mechanism of the recoiler mandrel upon which the slit metal is wound.

A plurality of circumferentially spaced, radially extending spikes 76 are provided about the spinner body at its axially outermost end. These spikes 76 serve to limit the extent of travel of the construct 14 onto the spinner as well as to position the strip coil to be separated in operative relation on the apparatus.

Movement of the construct 14 along support 24 to position the endmost strip coil on the spinner 64 is effected by pusher plate 18 which comprises a flat plate having a pair of vertically elongated, laterally spaced clearance openings 80 to permit the plate to be slidably received on the arms 30. A clearance opening 82 in the plate 18 permits unobstructed passage of the drive shaft 46.

Figure 4:
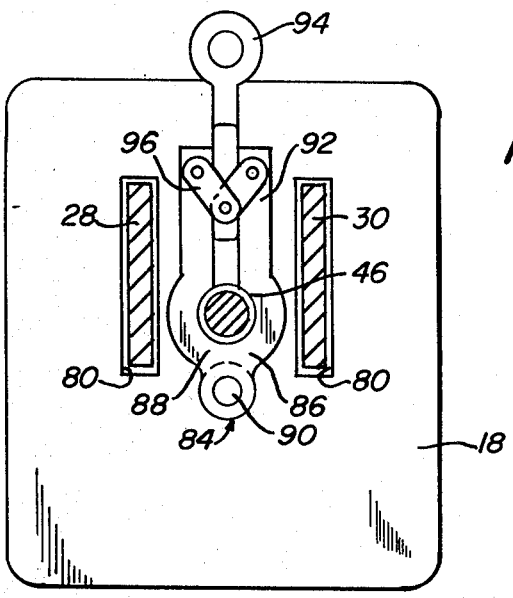
FIG. 4 is an end view of the apparatus of FIG. 1.

A split nut 84 is attached to the plate 18 to selectively and detachably connect it to the drive shaft 46 in order to impart movement of the plate along support 24. The split nut 84 comprises two internally threaded nut halves 86, 88 that are connected via pivot pin 90 to the rear face of the plate 18 for engagement with the threaded portion 53 of drive shaft 46. As shown in FIG. 4, the nut halves 86, 88 are each provided with upstanding extensions 92 that connect with an operating handle 94 through toggle links 96 for opening or closing the nut halves about the drive shaft 46.

The operation of the hereindescribed apparatus is as follows. With the pusher plate 18 located rearwardly on the horizontal frame arms of plate members 28 and 30 forming support 24 and the spinner 64 detached from the drive shaft 46, a sheet metal construct of the described type is mounted on the frame such that the support 24 extends through the axial opening in the construct. Thereafter, the spinner 64 is attached to the drive shaft extension 62 and the apparatus is ready for operation.

When it is desired to remove a strip coil 12 from construct 14, motor 42 is energized to rotate drive shaft 46 and the operating handle 94 is lifted to constrict the split nut halves 86, 88 into engagement with the drive shaft threaded portion 53. With the pusher plate 18 operatively connected to the drive shaft the plate is moved to urge the construct 14 along the support 24 until the end of the coil 12 to be detached abuts the limit spikes 76 on spinner 64. Through appropriate limit controls (not shown) operation of the drive motor 42 is terminated when the end of the construct 14 abuts the spikes 76 until the operating handle 94 is depressed to disconnect the pusher plate 18 from the drive shaft. The strip coil 12 is now positioned on the spinner 64 with its parting line 16 located in alignment with the clearance space 69. The spinner 64 is manually manipulated to place tang 74 into position in one of the gripper slots 72, following which drive motor 42 is reactivated to rotate the spinner 64 with the retained end of the strip coil 12.

Spinner 64 is caused to rotate in a direction opposite to that in which the strip is wound in the coil 12 thereby urging the material to wind tightly onto the external surface 70 of the spinner. Winding the strip onto the spinner body produces a relative movement between the strip being separated and the adjacent strip in the balance of the construct 14 which remains motionless on the support 24. Such relative movement creates a tensile-shearing action sequentially on each tab that interconnects the strip being separated with the adjacent material. This shearing action is sufficient to fracture the tabs and permit succeeding wraps of the coil to wind down on the preceding wrap enabling the so-created relative movement to continue through the coil 12 until all of the tabs are broken and the coil is detached from the construct.

Following separation of the strip coil 12 from the construct 14 the strip material can be conveniently payed out from the coil to a work station, or the like, by simply reversing the operation of motor 12 to cause the drive shaft 46 and spinner 64 to rotate in the opposite direction.

Figure 5:
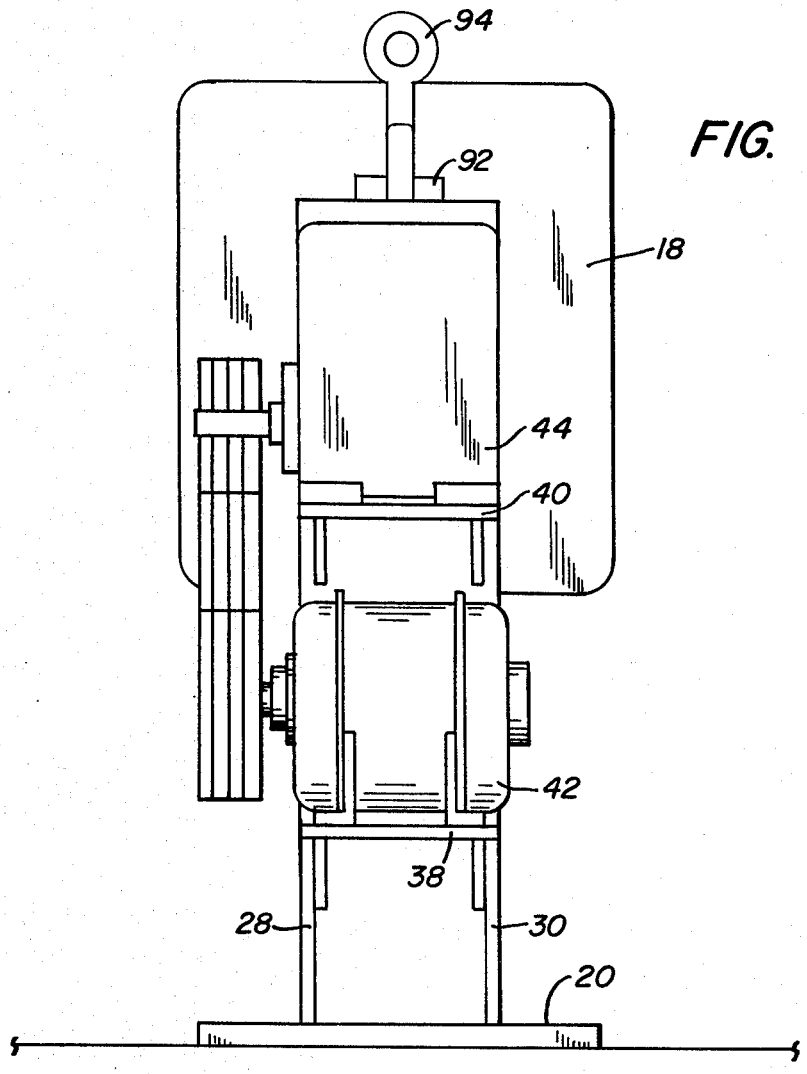
FIG. 5 is a view taken along line 5—5 of FIG. 3.
Figure 6:
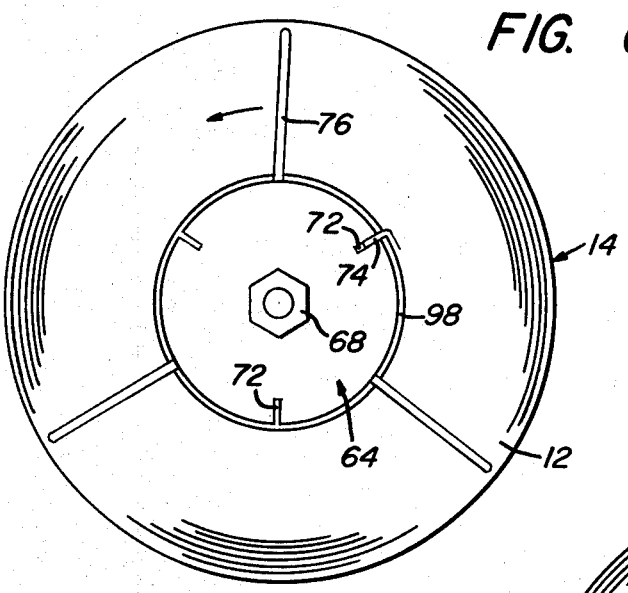
FIGS. 6, 7 and 8 are partial end views of a strip coil illustrating the same during various stages of the separation procedure.
Figure 7:
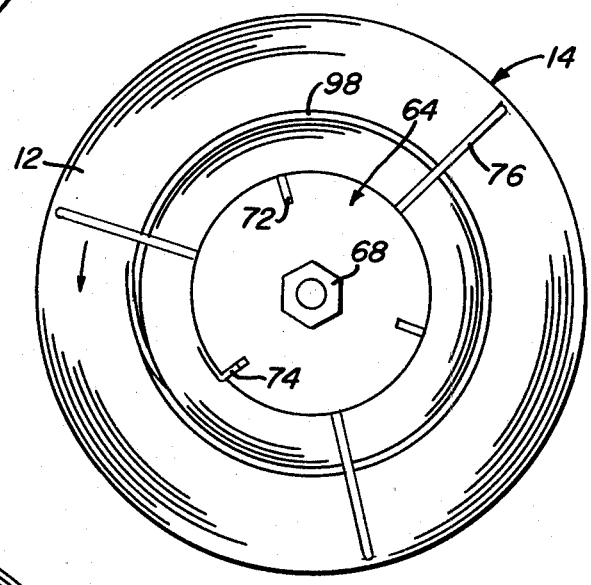
Figure 8:
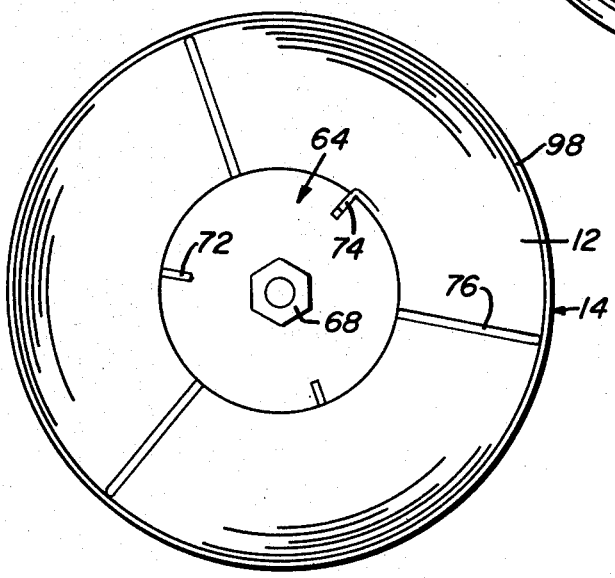

The technique employed to separate the strip coil 12 from construct 14 is described in greater detail in U.S. patent application Ser. No. 129,964 by W. A. Box, filed Mar. 13, 1980. As explained in that disclosure, power requirements for separating a strip can be reduced by providing the spinner 64 with an outer diameter that creates a clearance space between it and the facing surface of the inner wrap of the coil 12. The clearance space or gap is indicated in FIG. 5 herein as 98. Thus, when the spinner 64 is rotated the inner wrap of the coil 12 first winds tightly on the surface 70 closing the gap 98 and as rotation continues succeeding wraps wind upon the preceding wraps such that the gap 24 appears to expandingly translate through the coil as shown in FIGS. 6 and 7 until the coil is completely separated and its outer diameter is slightly reduced from its original diameter due to its being in a more tightly wound condition. By creating the gap 98 between adjacent coil wraps during winding effectively eliminates the effect of friction forces that would otherwise exist if the surface 70 of spinner 64 were constructed for minimal clearance in the axial opening of the coil. In practice, a gap 98 of only about one-fourth inch is effective to substantially eliminate friction forces when operating on strip material of about an inch thickness.

It will be understood that various changes in the details, materials and arrangements of parts which have been herein described and illustrated in order to explain the nature of the invention, may be made by those skilled in the art within the principle and scope of the invention as expressed in the appended claims.

I claim:

1. Apparatus for detaching and dispensing strip material from a wound construct having an axial opening therethrough and including a plurality of axially spaced coils of strip material interconnected by frangible connections, said apparatus comprising:

(a) a frame including means for telescopically receiving said construct through the axial opening therein;

(b) a spinner rotatably attached to said frame, said spinner having an external diameter to be received in the axial opening of said construct;

(c) gripper means in said spinner for attaching the innermost free end of the strip to be separated; and (d) mechanical drive means operatively connected to said spinner for rotating the same in a direction to create relative movement between the strip coil to be separated and the remainder of the construct to effect detachment of the frangible connections therebetween, said drive means being operative following separation of the strip coil to rotate said spinner for unwinding the strip material therein.

2. Apparatus as recited in claim 1 in which said drive means is reversible to rotate said spinner in one direction to effect separation of said strip coil and in the opposite direction for unwinding said strip following separation.

3. Apparatus as recited in claims 1 or 2 including a pusher plate movably mounted on said frame for moving said construct with respect to said hub.

4. Apparatus as recited in claim 3 in which said pusher plate is detachably connected to said mechanical drive means to derive motive force therefrom.

5. Apparatus as recited in claim 1 in which said frame comprises an elongated support for receiving said construct, bearing means spacedly positioned in said support, an elongated externally threaded drive shaft journalled for rotational movement in said bearing means, means at one end of said drive shaft for attaching said spinner for rotational movement therewith, motor means for rotatably driving said drive shaft, and means at the other end of said drive shaft for connecting said drive shaft to said motor means.

6. Apparatus as recited in claim 5 in which said drive shaft is rotatable in opposite directions and in which said motor means includes a reversible motor.

7. Apparatus as recited in claims 5 or 6 including a pusher plate mounted for sliding movement on said support and means for detachably connecting said pusher plate to said drive shaft.

8. Apparatus as recited in claim 7 in which said connecting means comprises an internally threaded split nut attached to said plate in surrounding relation to said drive shaft, and means for selectively constricting said split nut into threaded engagement with said drive shaft or for expanding the same out of engagement therewith.

* * * * *

UNITED STATES PATENT AND TRADEMARK OFFICE

CERTIFICATE OF CORRECTION

PATENT NO. : 4,267,985

DATED : May 19, 1981

INVENTOR(S) : John W. Rogers

It is certified that error appears in the above-identified patent and that said Letters Patent are hereby corrected as shown below:

Column 1, line 61, after "4,191,318", insert --, granted March 4, 1980 --.

Signed and Sealed this

First Day of September 1981

[SEAL]

*Attest:*

GERALD J. MOSSINGHOFF

*Attesting Officer*

*Commissioner of Patents and Trademarks*